US007711275B2

(12) United States Patent
Miyashita

(10) Patent No.: US 7,711,275 B2
(45) Date of Patent: May 4, 2010

(54) IMAGE FORMING APPARATUS HAVING AN IMAGING CONDITION SETTING CONTROL

(75) Inventor: Yoshiaki Miyashita, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 259 days.

(21) Appl. No.: 11/614,340

(22) Filed: Dec. 21, 2006

(65) Prior Publication Data

US 2007/0147868 A1 Jun. 28, 2007

(30) Foreign Application Priority Data

Dec. 28, 2005 (JP) ..... 2005-379863

(51) Int. Cl.
*G03G 15/00* (2006.01)

(52) U.S. Cl. ..... 399/37; 399/88

(58) Field of Classification Search ..... 399/75, 399/37, 88, 44, 50

See application file for complete search history.

(56) References Cited

U.S. PATENT DOCUMENTS

| | | | | |
|---|---|---|---|---|
| 5,170,210 | A * | 12/1992 | Saruwatari | 399/44 |
| 5,557,373 | A | 9/1996 | Miyashita et al. | |
| 5,585,896 | A | 12/1996 | Yamazaki et al. | |
| 5,805,954 | A * | 9/1998 | Takahashi | 399/44 |
| 6,259,869 | B1 * | 7/2001 | Abe et al. | 399/50 |
| 6,850,718 | B2 | 2/2005 | Miyashita | |
| 2001/0046388 | A1 * | 11/2001 | Inoue et al. | 399/44 |
| 2005/0158067 | A1 | 7/2005 | Kim et al. | |

FOREIGN PATENT DOCUMENTS

| | | | |
|---|---|---|---|
| EP | 1 050 411 | A1 | 11/2000 |
| EP | 1 251 410 | A2 | 10/2002 |
| JP | 8-262940 | | 10/1996 |
| JP | 9-311538 | | 12/1997 |
| JP | 11-160921 | | 6/1999 |
| JP | 2001215762 | A * | 8/2001 |
| JP | 2003-005465 | | 1/2003 |
| JP | 2003-177638 | | 6/2003 |
| JP | 2003-345180 | | 12/2003 |
| JP | 2004-13101 | | 1/2004 |
| JP | 2004069803 | A * | 3/2004 |

* cited by examiner

*Primary Examiner*—Quana M Grainger
(74) *Attorney, Agent, or Firm*—Oblon, Spivak, McClelland, Maier & Neustadt, L.L.P.

(57) ABSTRACT

A printer in which, while achieving a stabilization of image quality by process control processing, the generation of unnecessary wait time to the user, shortening of lifespan of the apparatus and needless consumption of toner caused by unnecessary execution of the process control processing can be better suppressed than in the prior art. An NVRAM serving as non-volatile information storage device in which stored information is retained even if the supply of power from an engine unit power source circuit is cutoff is provided in an engine unit, and timing signal information output from a timing circuit when the process control processing is executed is stored in the NVRAM, the engine unit being configured so as to judge, when power supply from the engine unit power source circuit starts, whether or not process control processing is to be executed in accordance with the timing signal information stored in the NVRAM and the timing signal output from the timing circuit.

13 Claims, 10 Drawing Sheets

IMAGE FORMING APPARATUS HAVING AN IMAGING CONDITION SETTING CONTROL

BACKGROUND OF THE INVENTION

1. Field of the Invention

The present invention relates to an image forming apparatus that measures the imaging performance of visible image forming means in accordance with the start of power being supplied from a power source, and that executes an imaging condition setting control for setting imaging conditions in response to the measured result.

2. Description of the Related Art

In image forming apparatuses of this type an imaging condition setting control is executed to measure the imaging performance of visible image forming means immediately following the switching ON of a power source or immediately following reversion from an energy saving mode at a prescribed timing such as, for example, when a predetermined number of printed copies have been produced. The energy save mode constitutes an image forming command standby mode occurring in a state in which, when image forming commands such as a copy start button operation or a print command signal have not been implemented for at least a prescribed period, the power supply to a heating heater of a fixing device or the like is interrupted.

A known image forming apparatus in which this kind of imaging condition setting control is executed is described in Japanese Unexamined Patent Application No. 2003-345180. In this image forming apparatus the following process controls are executed as imaging condition setting controls. That is to say, first of all a plurality of patch latent images of different optical write intensity and shape established in advance are formed on a photosensitive body, and the electric potential of these patch latent images is detected by an electric potential sensor. These patch latent images are developed by a development apparatus to produce a plurality of patch toner images that serve as reference images, and the quantities of toner affixed per unit surface area to each patch toner image is detected by an optical sensor. Next, the imaging performance of visible image forming means configured from the photosensitive body, optical write device and development apparatus and so on is determined in accordance with the relationship between the electric potential of the patch latent images and the quantities of toner affixed to the patch toner images. Upon measurement of the imaging performance of visible image forming means in this way, imaging conditions such as control target values for the uniform charging potential of the photosensitive body, the development bias, the optical write intensity on the photosensitive body and the toner density of the developer are set. As a result of a suppressing of the fluctuations in imaging density or gradient reproducibility which are attributable to fluctuations in the environment (temperature and humidity) and toner characteristics (fluidity and bulk density and so on) afforded by this imaging condition setting control, high quality images can be stably formed for a long period.

A further process control executing condition considered in this image forming apparatus described in Japanese Unexamined Patent Application No. 2003-345180 immediately following switching ON of the power source or immediately following reversion from the energy save mode is the temperature of the fixing roller. This condition is considered with a view to avoiding a situation where the user is forced to wait an unnecessarily long time due to a process control being needlessly executed. More specifically, if the fixing roller exceeds a predetermined temperature (for example, not less than 50° C.) immediately following switching ON of the power source or immediately following reversion from the energy save mode, the period of time that the power source is OFF and the energy save mode is executed is very short (for example, several minutes). Marked fluctuations in the environment or the toner characteristics are unlikely to occur in such a short time. Accordingly, the change in imaging performance from the period immediately prior to interruption to the power source or immediately prior to transition to the energy save mode is essentially negligible. If a process control were to be nonetheless executed the user would be forced to wait unnecessarily. Thereupon, when the fixing roller exceeds a predetermined temperature immediately following switching ON of the power source or immediately following reversion from the energy save mode there is no process control executed. According to this configuration, the occurrence of the user being made to wait unnecessarily can be suppressed.

However, the inventor of the present invention discovered through testing that, even with this configuration, the user was sometimes forced to wait unnecessarily. More specifically, over a medium period of power source cutoff time or energy save mode execution such as between several tens of minutes and several hours there were sometimes insignificant fluctuations in the environment and toner characteristics. Accordingly, in this case it is also desirable for the executing of a process control immediately following switching ON of the power source or immediately following reversion from the energy to be omitted. However, over a medium period of power source cutoff time or energy save mode execution time the temperature of the fixing roller drops to about room temperature. Accordingly, the process control is executed and the user is forced to wait unnecessarily.

Notably, accompanying the demand for improved energy saving that has arisen in recent years, many image forming apparatus specifications have been designed so that a transition to the energy save mode occurs simply as a result of an image forming command having not been received for a very short time such as for several minutes. Accordingly, the user is frequently made to wait unnecessarily.

In addition, a user with a strong energy saving consciousness will switch the power source switch to OFF each time they complete a print operation. A user of this type is also frequently made to wait unnecessarily.

Apart from the user being forced to wait unnecessarily when an unnecessary imaging condition setting control is executed, the lifespan of visible image forming means is reduced and the image forming agents such as toner are needlessly consumed. This is because, to form the reference visible images such as the patch toner images for the imaging condition setting control, visible image forming means is actuated and image forming agents are consumed.

Almost all conventional image forming apparatuses in which an energy save mode is executed comprise a timer function for ascertaining whether the time since an image forming command was received exceeds a prescribed time. However, the energy save mode execution time and power source cutoff time cannot be ascertained utilizing this timer function. The timer function cannot be utilized for the energy save mode execution time and power source cutoff time because the power source supply to the timer circuit and control unit is cutoff at these times.

Technologies relating to the present invention are disclosed in, e.g.,

Japanese Unexamined Patent Application No. H11-160921, Japanese Unexamined Patent Application No. 2003-177638 and Japanese Unexamined Patent Application No. 2004-013101.

SUMMARY OF THE INVENTION

With the foregoing in view, it is an object of the present invention to provide an image forming apparatus in which, while achieving a stabilization of image quality by imaging condition setting control, the occurrence of unnecessary wait time to the user, the shortening of the lifespan of visible image forming means, and the wasteful consumption of image forming agents caused by execution of an unnecessary imaging setting control can be better suppressed than in the conventional art.

In an aspect of the present invention, an image forming apparatus comprises an image formation acquisition device for acquiring image information; a visible image forming device for forming a visible image on a surface of an image carrier in accordance with the image information; a control device for measuring imaging performance of the visible image forming device in accordance with a start of a power supply from a power source and executing an imaging condition setting control for setting imaging conditions in response to the measured result; and a signal output device for changing an output signal in response to event changes. The control device comprises a non-volatile information storage device for retaining stored information even if the supply of power from the power source has been interrupted, stores in the non-volatile information storage device signal information output from the information output device when executing the imaging condition setting control and, when the supply of power from the power source starts, judges whether or not the imaging condition setting control is to be executed in accordance with the signal information stored in the non-volatile information storage device and the signal output from the information output device.

In another aspect of the present invention, an image forming apparatus comprises an image information acquisition device for acquiring image information; an visible image forming device for forming a visible image on a surface of an image carrier in accordance with the image information; a control device for measuring imaging performance of the visible image forming device in accordance with a start of a power supply from a power source and executing an imaging condition setting control for setting imaging conditions in response to the measured result; and a signal output device for changing an output signal in response to event changes. The control device comprises a non-volatile information storage device for retaining stored information even if the supply of power from the power source has been interrupted, stores in the non-volatile information storage device signal information output from the information output device when executing the imaging condition setting control and, when the supply of power from the power source starts, judges as the imaging condition setting control which of either a long time mode in which the imaging performance of the visible image forming device is measured over a comparatively long time or a short time mode in which the imaging performance is measured over a comparatively short time is to be executed in accordance with the signal information stored in the non-volatile information storage device and the signal output from the information output devices.

BRIEF DESCRIPTION OF THE DRAWINGS

The above and other objects, features and advantages of the present invention will become more apparent from the following detailed description based on the accompanying drawings in which.

DESCRIPTION OF THE PREFERRED EMBODIMENTS

Embodiments based on the application of the present invention in an electrophotographic color printer (hereinafter printer) serving as the image forming apparatus will be hereinafter described.

Figure 1:
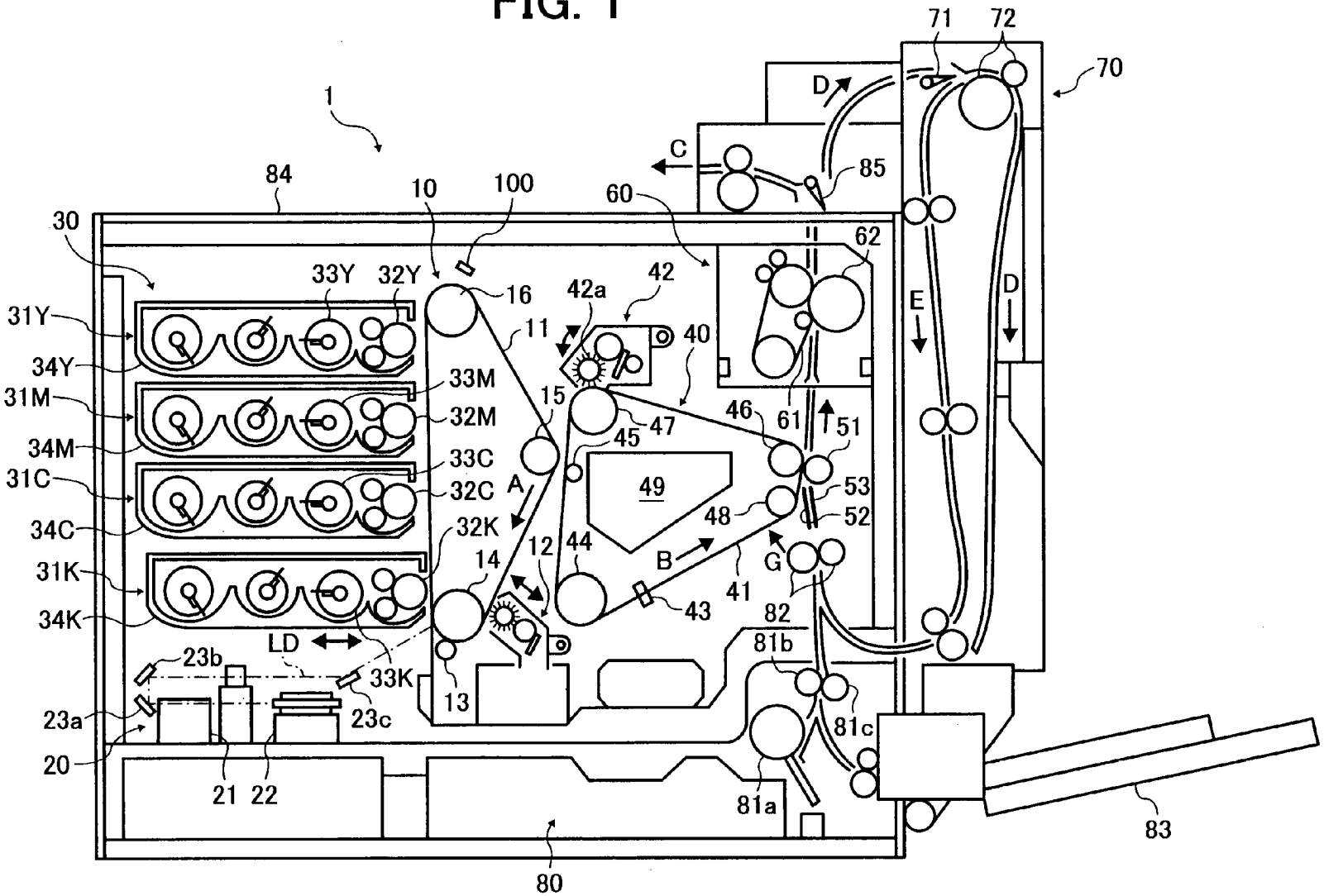
FIG. 1 is a diagram showing the schematic configuration of a printer pertaining to a first embodiment of the present invention.

FIG. 1 shows the schematic configuration of a printer pertaining to a first embodiment of the present invention. A printer 1 in the diagram comprises a photosensitive body unit 10, optical write unit 20, development unit 30, transfer unit 40, fixing unit 60, inverting unit 70, paper feed cassette 80 and manual feed tray 83 and so on. Toner images of black (hereinafter referred to as K), cyan (hereinafter referred to as C), magenta (hereinafter referred to as M) and yellow (hereinafter referred to as Y) are sequentially formed on a photosensitive belt 11 of the photosensitive body unit 10.

A photosensitive body cleaning device 12, charging roller 13, the development unit 30 and the transfer unit 40 are arranged around the continuous photosensitive belt 11. The photosensitive belt 11 is tensioned while being supported from the rear surface side by a drive roller 14, primary transfer opposing roller 15 and tensioning roller 16 and is continuously moved in the clockwise direction in the diagram accompanying the rotation of the drove roller 14 rotationally-driven by drive means not shown in the diagram. When a photosensitive belt 11 with a coupling is employed it is desirable that the coupling be provided in the non-image forming region in the end part in the width direction of the photosensitive belt 11 and, in addition, that this be detected by a sensor not shown in the diagram and, based on the detected result thereof, that the later-described optical writing be implemented in the belt region avoiding the coupling.

The optical write unit 20 comprises a semiconductor laser 21, laser-emitting drive control unit not shown in the diagram, polygon mirror 22, and three reflecting mirrors 23*a, b, c* and so on. Conversion to an optical signal is performed on the basis of color image information sent from a personal computer not shown in the diagram, and optical writing correspondent to the color images is administered on the photosensitive belt 11 in accordance therewith. As a result, K, C, M, Y electrostatic latent images are sequentially formed on the surface of the photosensitive body 11.

The development unit 30 supports four K, C, M, Y development units 31K, C, M, Y in an arrangement in the perpendicular direction in which they oppose the perpendicular direction tensioned surface of the photosensitive belt 11. Each of these development units 31K, C, M, Y are moved in the left-to-right direction in the diagram by an contact-separation mechanism not shown in the diagram so as to contact and be separated from the perpendicular direction tensioned surface of the photosensitive body 11. The development unit additionally comprises development rollers 32K, C, M, Y, agitation paddles 33K, C, M, Y, and casings 34K, C, M, Y not shown in the diagram in which the toners K, C, M, Y are housed. The development rollers 32K, C, M, Y, of which one part of the circumferential surface is exposed through an opening provided in the end part in the longitudinal direction of the casings 34K, C, M, Y, carry the K, C, M, Y of the casings 34 K, C, M, Y while being rotationally-driven by drive means not shown in the diagram. In addition, the agitation paddles 33 K, C, M, Y are rotationally-driven by drive means not shown in the diagram to convey the K, C, M, Y toners of the casings 34 K, C, M, Y toward the development rollers 32 K, C, M, Y. A development bias is imparted by a development bias power source not shown in the diagram to the development rollers 32 K, C, M, Y whereupon the development rollers 32 K, C, M, Y are biased to a predetermined electrical potential with respect to the photosensitive belt 11.

When an electromagnetic clutch not shown in the diagram of the contact-separation mechanism of the development unit 30 for transmitting drive to the development units 31 K, C, M, Y from a motor not shown in the diagram is ON, the drive force thereof moves the casings 34K, C, M, Y toward the photosensitive belt 11 side (right side in the diagram). For development, one selected development unit of the development unit 31K, C, M, Y is moved so as to abut the photosensitive belt 11. On the other hand, when the excitation to the electromagnetic clutch is stopped, the development unit abutting the photosensitive belt 11 is moved in the direction away from the photosensitive belt 11 (left side in the diagram).

When the printer main body is in the standby state, the development unit 30 sets each of the development units 31K, C, X, Y in a position away from the photosensitive belt 11. When a print operation is started, an optical scanning is performed on the photosensitive belt 11 in accordance with K image information of the color image information forming a K electrostatic latent image on the photosensitive belt 11. In order to ensure development from the tip end part of the K electrostatic latent image, the K development unit 31K is caused to abut the photosensitive belt 11 and the rotation of the development roller 32K is started prior to the tip end of the K electrostatic latent image reaching the K development position in which the K development unit 31K and photosensitive belt 11 are opposing. As a result, the K electrostatic latent image is developed on the photosensitive belt 11 as a K toner image by the K development apparatus. Immediately the tip end of the K electrostatic latent image passes the K development position, the K development unit 31K is separated from the photosensitive belt 11 and the C development unit 31C promptly abuts the photosensitive belt 11. This is implemented at least prior to the tip end of the electrostatic latent image tip based on the C image information reaching the C development position. The C electrostatic latent image is developed as a C toner image on the photosensitive belt 11 from the tip end. This identical development process is subsequently implemented for M, Y.

The transfer unit 40 comprises a continuous intermediate transfer belt 41, belt-cleaning device 42, position detection sensor 43, drive roller 44, primary transfer roller 45, secondary transfer opposing roller 46, cleaning opposing roller 47, waste toner tank 49, secondary transfer roller 51, upper guide panel 52, lower guide panel 53, and secondary transfer bias imparting means and secondary transfer roller contact-separation means not shown in the diagram and so on.

The intermediate transfer belt 41 serving as the image carrier is tensioned by the drive roller 44, primary transfer roller 45, secondary transfer opposing roller 46 and cleaning opposing roller 47. The intermediate transfer belt is continuously moved in the anti-clockwise direction in the diagram (direction of the arrow B) by rotation of the drive roller 44 rotationally-driven by drive means not shown in the diagram. A plurality of position detection marks (not shown in the diagram) is provided in the non-image forming region in the end part in the axial direction of the intermediate transfer belt 41. The image forming start timing is set in accordance with a timing detected by the position detection sensor 43 of any one of these position detection marks (the position detection mark through which the position detection sensor 43 first passes when image forming operation is started).

While being sandwiched between the primary transfer opposing roller 15 and primary transfer roller 45, the surfaces of the photosensitive belt 11 and intermediate transfer belt 41 are caused to abut forming a primary transfer nip. The K, C, M, Y toner images formed on the photosensitive belt 11 are sequentially superposed and transferred onto the intermediate transfer belt 41 at the primary transfer nip. As a result, a 4-color superposed toner image (hereinafter, 4-color toner image) is formed on the intermediate transfer belt 41.

The belt-cleaning device 42 comprises a cleaning brush 42*a* and contact-separation mechanism not shown in the diagram. During at least the period that the color toner images are being primary transferred onto the intermediate transfer belt 41, the cleaning brush 42*a* lies in standby in a position away from the surface of the intermediate transfer belt 41. Thereupon, in accordance with need, the cleaning brush 42*a* is moved to the cleaning position by the contact-separation mechanism and is caused to slide along the surface of the intermediate transfer belt 41 to clean the secondary transfer residual toner on the intermediate transfer belt 41. The cleaned toner is accumulated in the waste toner tank 49 arranged in the inner side of the intermediate transfer belt 41 loop.

The transfer unit 40 comprises belt contact-separation means not shown in the diagram and, due to changes in the tensioned state of the intermediate transfer belt 41 as a result of the drive thereof, the surface of the intermediate transfer belt 41 is caused to abut the secondary transfer roller 51 forming a secondary transfer nip and then separate from the secondary transfer roller 51 to remove the secondary transfer nip. When a superposed transfer of color toner images onto the intermediate transfer belt 41 is being performed, the surface of the intermediate transfer belt 41 is separated from the secondary transfer roller 51. Thereupon, directly prior to the tip end of the 4-color toner image produced by superposed transfer reaching the part where the belt wraps around the secondary transfer opposing roller 46, the surface of the intermediate transfer belt 41 is caused to abut the secondary transfer roller 51 forming a secondary transfer nip.

A transfer paper not shown in the diagram serving as a recording member is housed in a paper feed cassette 80 and conveyed toward a resist roller pair 82 by paper feed rollers 81*a, b, c*.

A freely openable manual feed tray 83 from which an OHP paper or original document or the like is fed out toward the resist roller pair 82 is arranged in the left-side face of the printer 1 main body.

The resist roller pair 82 feeds out the recording paper and so on fed out from the paper feed cassette 80 or manual feed tray 83 toward the secondary transfer nip at a timing that is synchronized with the 4-color toner image on the intermediate transfer belt 41. A secondary transfer bias of reverse polarity to the toner is imparted to the secondary transfer roller 51 and, as a result, a secondary transfer electric field is formed between the secondary transfer opposing roller that tensions the intermediate transfer belt 41 and the secondary transfer roller 51. The 4-color toner images on the intermediate transfer belt 41 are secondary transferred as a whole onto the recording paper due to the effect of this secondary transfer electric field and nip pressure and, in conjunction with the white color of the recording paper, form a full color image.

The units as explained here are easily detachable from the printer main body. For example, the removal of the transfer unit 40 is simple and involves merely the front-face cover not shown in the diagram being opened and the unit being slide in the direction in the plane of the paper from the rear side toward the front side.

In the printer 1 of the configuration described above, when an image forming operation is started the photosensitive belt 11 is first of all rotated clockwise in the direction of the arrow A and the intermediate transfer belt 41 is rotated anti-clockwise in the direction of the arrow B. Thereupon, a charging roller 13 to which a charging bias is being imparted by a power source not shown in the diagram is rotated while in contact with the photosensitive belt 11 to uniformly charge the surface thereof. An optical scan is administered by means of a laser light LD on the surface of the uniformly charged photosensitive belt 11 in accordance with K image information. As a result, a loss of electric charge proportionate to the quantity of exposure light occurs from the exposed section of the photosensitive belt 11 whereupon the exposed section is formed as the K electrostatic latent image. Thereupon, before entering the primary transfer nip described above accompanying the continuous movement of the photosensitive belt 11, the K electrostatic latent image is developed as a K toner image by the K development unit 31K. A primary transfer electric field is formed in the primary transfer nip as a result of the imparting of a primary transfer bias to the primary transfer roller 45 arranged in proximity therewith by a power source not shown in the diagram and the earthing of the primary transfer opposing roller 15. The K toner image that has entered the primary transfer nip is primary transferred onto the intermediate transfer belt 41 due to the action of the primary transfer electric field and pressure within the nip and so on. Thereafter, C, M, Y toner images are similarly sequentially formed on the photosensitive belt 11 before being sequentially superposinly primary transferred onto the K toner image of the intermediate transfer belt 41 in the primary transfer nip. While it is generally the case that during superposed primary transfer the primary transfer bias imparted to the primary transfer roller 45 is gradually increased, in some cases a predetermined primary transfer bias is imparted due to the resistance characteristics and so on of the intermediate transfer belt 41.

A small quantity of primary transfer residual toner not transferred to the intermediate transfer belt 41 affixes to the surface of the photosensitive belt 11 after it has passed the primary transfer nip. After this primary transfer residual toner has been removed from the surface of the photosensitive belt 11 by the photosensitive body cleaning device 12 it is accumulated by way of a recovery pipe not shown in the diagram in a waste toner tank. The surface of the photosensitive belt 11 from which the primary transfer residual toner has been removed in this way is decharged by a decharging lamp (not shown in the diagram).

After passing through the secondary transfer nip, the recording paper on which the full color image has been formed at the secondary transfer nip described above is fed to the fixing unit 60. The fixing unit 60 forms a fixing nip between a fixing belt 61 that is continuously moved while being tensioned by a fixing roller and so on that houses a heat source and a pressuring roller 62 that abuts the surface thereof. Thereupon, by the ON/OFF control of the power supply to the heat source of the fixing roller in accordance with the surface temperature of the fixing belt 61 detected by a temperature sensor not shown in the diagram, the surface temperature of the fixing belt 61 is maintained at a temperature of the order of 140[° C.]. The recording paper fed to the fixing unit 60 is sandwiched by the fixing nip described above and as a result of the nip pressure or pressure of the fixing belt 61, the full color image is fixed. Thereupon, after exiting the fixing unit 60, the recording paper is discharged to the exterior of the device (direction of the arrow C) and stacked with the rear side up on a discharge paper tray 84 formed in the upper surface of the printer frame body.

When printing on both sides of the paper is to be performed, the recording paper that has passed through the fixing unit 60 is guided in the direction of the arrow D by a double-side changeover clasp 85 and fed to an inverting unit 70. After the rear end of the recording paper has passed by an inverting changeover clasp 71, an inverting roller pair 72 stops and, in turn, the recording paper stops. Thereupon, after a predetermined blank time has elapsed, the reverse rotation of the inverting roller pair 72 is started and a switchback of the recording paper begins. A switchover of the inverting changeover clasp 71 occurs at this time and the recording paper is guided in the direction of the arrow E and fed to the resist roller pair 82. The recording paper fed to the resist roller pair 82 lies in standby in an inverted state at the nip of the resist roller pair 82. Thereupon, the resist roller pair 82 is driven at a predetermined timing and the recording paper is fed to the secondary transfer position where, following the transfer of the 4-color superposed toner images as a whole from the intermediate transfer belt 41 and the fixing of the full color image by the fixing unit 60, it is discharged to the exterior of the apparatus.

In a printer comprising this fundamental configuration, visible image forming means for forming a toner image which constitutes a visible image in accordance with image information on the surface of the intermediate transfer belt 41 which constitutes an image carrier is configured from the photosensitive body unit 10, optical write unit 20 and transfer unit 40.

Figure 2:
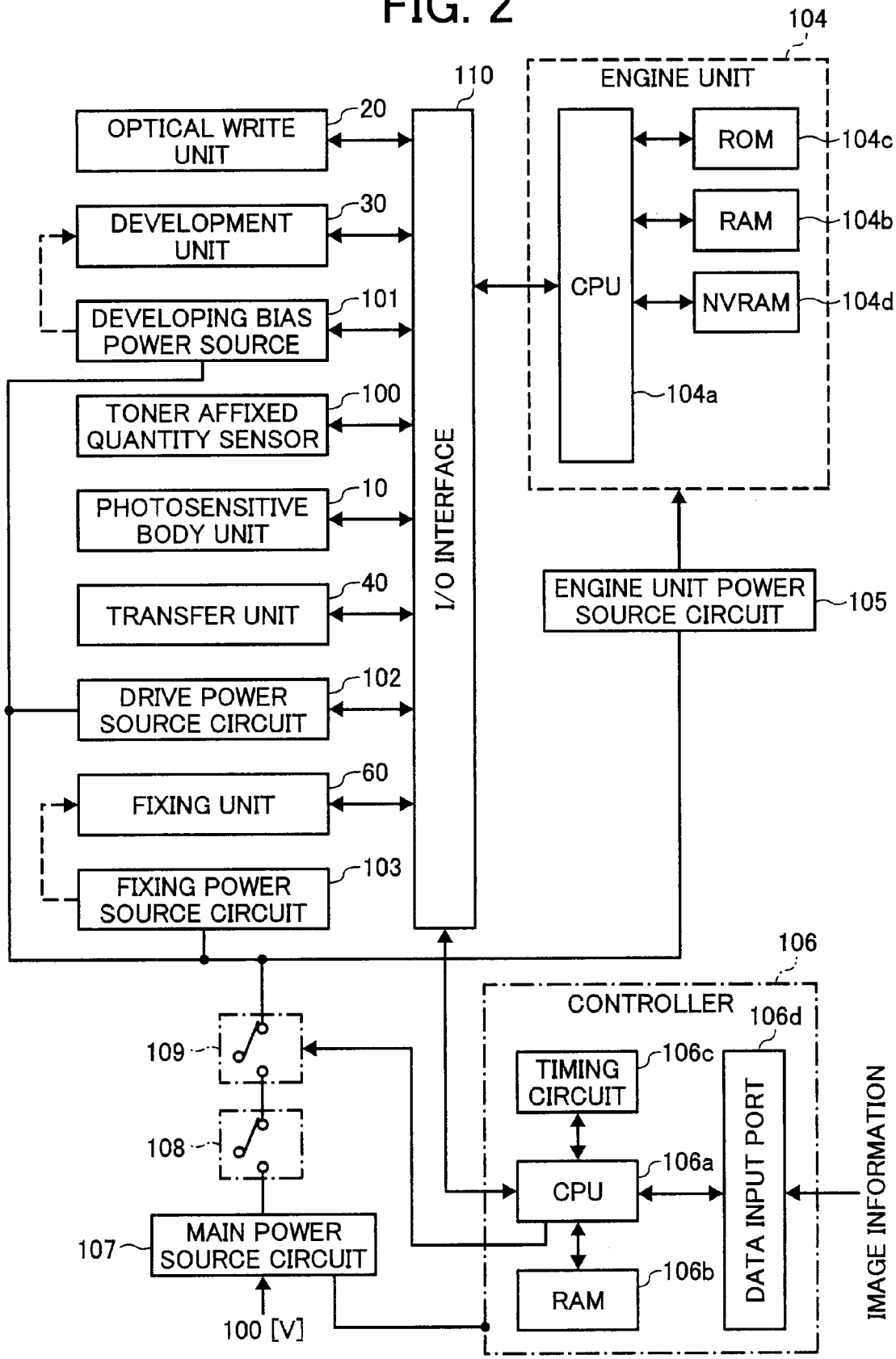
FIG. 2 is a block diagram of a part of an electrical circuit of this copier.

FIG. 2 shows a part of the electrical circuit of this printer. The printer comprises a control unit that oversees the control of the various components of the printer, the control unit being configured from an engine unit 104 and controller 106.

The engine unit 104 of the control unit is connected by way of an I/O interface 110 with the optical write unit 20, development unit 30, development bias power source 101, toner affixed quantity sensor 100, photosensitive body unit 10, transfer unit 40, drive power source 102, fixing unit 60 and fixing power source circuit 103 and so on.

The development bias power source 101 outputs a high voltage development bias to each of the development rollers (32K, C, M, Y) of the development units for each color and, in accordance with a control signal from the engine unit 104, individually regulates the output voltage value to the development rollers.

The toner affixed quantity sensor 100 which, as shown in FIG. 1 noted earlier, is arranged in the perimeter of the photosensitive belt 11, detects the toner affixed quantity per unit surface area of a later-described reference toner image formed on the end part in the width direction of the photosensitive belt 11 and outputs a voltage in response to the detected result. This output voltage value is converted to digital data from analog data by an A/D controller not shown in the diagram and then input into the engine unit 104.

The drive power source 102 performs the ON/OFF of the power supply to a drive source (for example a drive motor) for each unit in accordance with a control signal from the engine unit 104.

The fixing power source circuit 103 switches ON the power supply to the heat source within the fixing roller in accordance with an output signal from a temperature sensor not shown in the diagram for detecting the surface temperature of the fixing belt of the fixing unit 60.

The engine unit 104 is configured from a CPU (Central Processing Unit) 104*a*, ROM (Read Only Memory) 104*c* in which various control programs and control parameters are stored, RAM (Random Access Memory) 104*b* in which various data serving as the work domain is temporarily stored, and a later-described NVRAM (Non Volatile Random Access Memory) 104*d* and so on.

The CPU 106*a*, RAM 106*b*, a timing circuit 106*c*, a data input port 106*d* and a controller 106 are connected to the engine unit 104 and the various units by way of the I/O interface 110. The image information signal fed from an external apparatus such as a personal computer is acquired by the data input port 106*d* serving as image information acquisition means and output to the optical write unit 20 and engine unit 104.

In this printer, a primary power supplied from an exterior 100 [V] power point or the like is input into a main power source circuit 107. The power output from the main power source circuit 107 is supplied to a power source switch 108 and, by way of a relay circuit 109, to the development bias power source 101, drive power source 102, fixing power source circuit 103, and engine unit power source circuit 105. The engine unit power source circuit 105 constitutes a circuit for supplying power to the engine unit 104.

The electrical contact between the main power source circuit and the various power source circuits is disconnected as a result of the operation of power source switch 108 by an operator. In addition, the relay circuit 109 disconnects the electrical contact between the power source switch 108 and the various power source circuits in accordance with a control signal from the controller 106. The implication of this is that, even in the connected electrical contact state of the power source switch 108, the power supply to the power source circuits, and in turn, the power supply to the drive sources and engine unit 104 is cutoff when the relay circuit 109 is in the disconnected electrical contact state. The power output from the main power source circuit 107 is directly supplied to the controller 106 by way of the power source switch 108 or the relay circuit 109.

The engine unit 104 is configured to execute an energy save mode request judgment processing at a prescribed timing. More specifically, the CPU 104*a* serving as timing means comprising a timer function of the engine unit 104 measures the elapsed time from when acquisition of image information by the data input port 106*d* of the controller 106 finishes or when a series of image forming operation controls (print shop controls) has been finished. When this elapsed time exceeds a predetermined time of, for example, several tens of minutes, it judges that transition to the energy save mode is required. In this case, it outputs an energy save mode signal to the controller 106. While the controller 106 normally outputs an electrical contact ON signal to the relay circuit 109, it stops this output subsequent to receiving an energy save mode request signal from the engine unit 104. As a result, the electrical contact of the relay circuit 109 is cutoff and power supply to the development bias power source 101, the drive power source 102, the fixing power source circuit 103 and the engine unit power source circuit 105 is stopped. When the energy save mode is executed the controller, in this state in which the power supply to each of the power sources and, in turn, to each unit, each drive source and the engine unit 104 has been cutoff, lies in standby for the receipt by the data input port 106*d* of an image information signal serving as an image forming command.

Power is supplied from the main power source circuit 107 to the controller 106 even when the energy save mode has been executed and, accordingly, an image information signal sent from a personal computer or the like is received via the data input port 106*d*. When an image information signal is received during execution of the energy save mode, the controller 106 outputs an electrical contact ON signal to the relay circuit 109. As a result, power is supplied to each of the power sources, to each unit, and to the engine unit 104 and results in reversion from the energy save mode.

Cutoff of the power supply to the engine unit 104 occurs when the power source switch 108 is switched OFF by an operator and when the energy save mode is executed. The engine unit 104 is configured to execute a process control processing which constitutes an imaging condition setting control in accordance with need when power is supplied subsequent to a switch of the power source switch 108 from OFF to ON and the end of the energy save mode currently being executed. However, this process control processing is executed in accordance with an output signal from a temperature sensor of the fixing unit 60 only when the temperature of the fixing belt is judged not to exceed 50[° C.]. As a result, when the power source OFF time or the energy save mode execution time is a very short time of several minutes or the like, a situation of the process control processing being unnecessarily executed is avoided.

Figure 3:
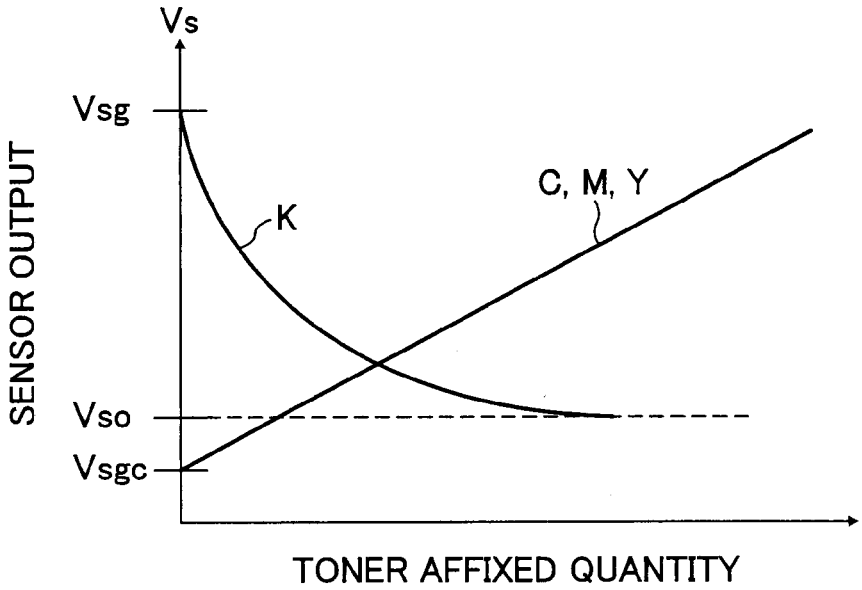
FIG. 3 is a graph showing the relationship between the output voltage from a toner affixed quantity sensor and toner affixed quantity.

The process control processing involves first of all a calibration of the toner affixed quantity sensor 100 described above. More specifically, the toner affixed quantity sensor 100 comprises an LED not shown in the diagram which constitutes a photoemitting element that emits light toward the surface of the photosensitive belt (11) and a diffuse reflection-type photoreceiving element not shown in the diagram which receives the diffused reflected light on the belt surface and outputs voltage in response to the quantity of light received. As shown in FIG. 3 in which the toner affixed quantity per unit surface area of the surface of the photosensitive belt 11 is depicted on the horizontal axis and the output voltage value is depicted on the vertical axis, the photoreceiving element exhibits a linear characteristic in which the output voltage value increases accompanying an increase in the toner affixed quantity of the C, M, Y color toners. On the other hand, it exhibits a curvature characteristic in which the output voltage value increases accompanying a decrease in the toner affixed quantity of K toner. The calibration of the toner affixed quantity sensor 100 also involves, in the OFF state of the emitted light from the LED, detection by the engine unit 104 of the output voltage value from the photoreceiving element as Vsg. A Vs0 value, which constitutes the saturated output voltage value from the photoreceiving element when a high-density black solid toner image has been detected, is stored in advance in the ROM 104*c* of the engine unit 104. The LED emitted light quantity is regulated so that the value obtained when Vs0 is subtracted from the Vsg described above is a predetermined value (for example 1.5V). The toner affixed quantity sensor 100 is calibrated on the basis of this regulation.

Subsequent to the implementation of this calibration of the sensor, a plotter rise operation is implemented. This plotter rise operation involves, after each of the drive motors have been started, the rise of the charging bias, development bias and transfer bias established in advance.

Figure 4:
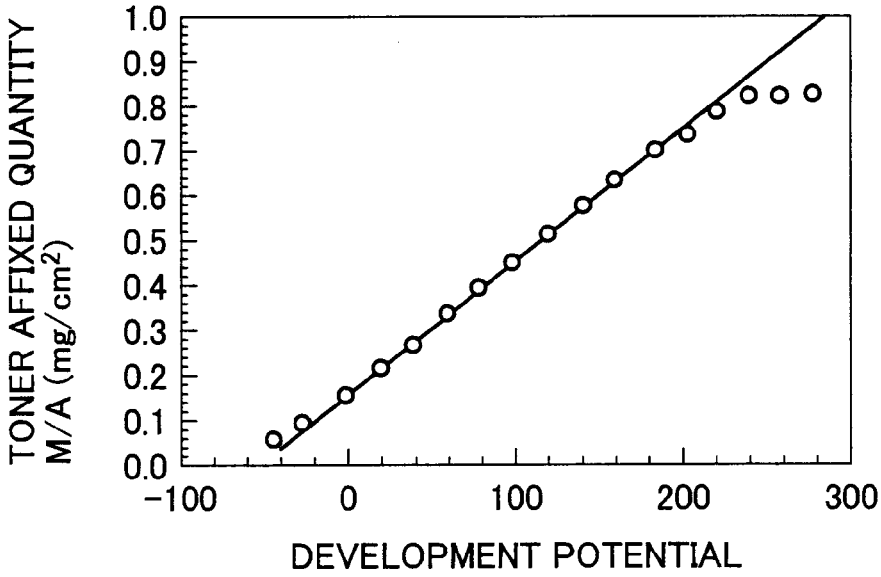
FIG. 4 is a graph showing the relationship between the toner affixed quantity sensor and development potential.

Subsequent to the plotter rise operation being implemented, a gradient pattern detection processing is implemented. This gradient pattern detection first of all involves forming of a K gradient pattern image configured from 17 reference toner images of different toner affixed quantity being on the photosensitive belt (11). The toner affixed quantity of the reference toner images of the K gradient pattern image is regulated at this time on the basis of differences in the development potential. Development potential constitutes the electric potential difference between the electrostatic latent image on the photosensitive belt (11) and the surface electric potential of the development roller (development bias VB). In addition, the development potential is regulated on the basis of differences in optical write intensity on the photosensitive belt (11). The electric potential of the electrostatic latent image of the reference toner images of the K gradient pattern image is detected prior to development by an electric potential sensor not shown in the diagram which outputs the detected result thereof to the engine unit 104. In addition, the reference toner images of the K gradient pattern image are detected by the toner affixed quantity sensor 100 accompanying the continuous movement of the photosensitive belt (11). The engine unit 104 calculates the development potential when the reference toner images are developed in accordance with the output signal from the electric potential sensor and the development bias VB. In addition, the toner affixed quantity of the reference toner images is calculated in accordance with the output signal from the toner affixed quantity 100 sensor. Thereupon, a linear approximation equation that expresses the relationship between the toner affixed quantity and the development potential as shown in FIG. 4 is calculated. This linear approximation equation expresses the imaging potential of visible image forming means. Accordingly, the engine unit 104 measures the imaging performance by executing this gradient pattern detection processing. After the linear approximation equation is produced and the optimum development potential for obtaining the target toner affixed quantity is specified in accordance therewith, a photosensitive belt uniform charging potential VL, a development bias VB, and an optical write intensity VD correspondent with this development potential are specified in accordance with a data table stored in advance in the ROM 104*c*. Thereupon, these specified results are stored in an NVRAM 104*d* serving as non-volatile information storage means. This gradient pattern detection processing is similarly executed for C, M, Y.

In executing a print job in accordance with image information signal following execution of the process control processing as described above, the photosensitive belt uniform charging potential VL, the development bias VB and the optical write intensity VD for each color are set when the process control processing is performed to values identical to the data stored in the NVRAM 104*d*. Moreover, when a low toner affixed quantity is detected, the adoption of a normal reflection-type photoemitting element for receiving normal reflected light as the photoemitting element is also possible.

In the process control processing as executed by this printer, when the power source OFF time or the energy save mode execution time is a medium period of time, an unnecessary process control as described earlier that forces the user to wait unnecessarily is sometimes executed immediately following the power source ON or immediately following rise from the energy save mode.

Moreover, the image forming apparatus described in Japanese Unexamined Patent Application No. 2003-345180 described above comprises a selection function that selects either a mode for executing or a mode for not executing the process control processing for the user. For a user not concerned about producing high-quality printing the wait time attributable to the executing of the processing control can be eliminated and the stress associated with "being made to wait" can be alleviated by selecting the latter of these modes. In addition, for a user concerned with producing high-quality printing, high quality images can be provided by selection of the former of these modes in accordance with need and executing of the processing control. However, there will of course be occasions when, when the latter of these modes is selected and the power source OFF time or the energy save mode execution time is a medium period of time, an unnecessary process control processing will be executed.

The characterizing features of the configuration of this printer will be hereinafter explained.

Figure 5:
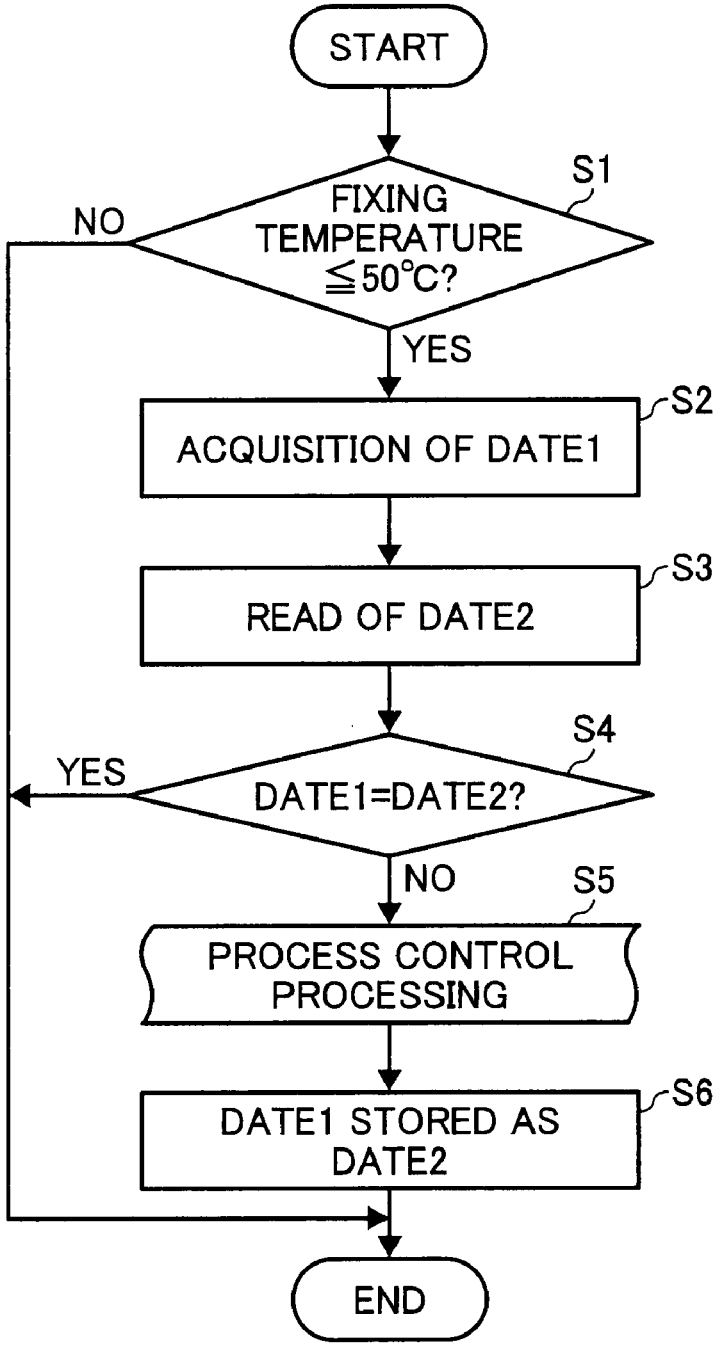
FIG. 5 is a flow chart showing an outline of the control flow of the post-rise routine processing executed by an engine unit of the printer.

FIG. 5 is a flow chart showing an outline of the control flow of a post-rise routine processing executed by the engine unit 104 of the printer. The post-rise routine processing is executed immediately following the start of the supply of power to the engine unit 104 subsequent to the switching ON of the power source switch 108 by an operator or reversion from the energy save mode. Thereupon, first of all, in accordance with the output signal from the temperature sensor of the fixing unit, a judgment as to whether or not the surface temperature of the fixing belt (fixing temperature) does not exceed 50° C. is made (Step 1: hereinafter the term Step is denoted simply as S). Thereupon, if the temperature does exceed 50° C. (N in S1), the post-rise routine processing is finished. In contrast, if the temperature does not exceed 50[° C.] (Y in S1), the control flow of S2 and beyond is executed.

For convenience, the control flow of S5 to S7 of the control flow of S2 and beyond will be explained first. In S5 the previously explained process control processing is executed. As a result, the imaging performance is measured and the set imaging conditions (development bias and so on) are stored in the NVRAM 104*d* in accordance with this measured result. Following this, and subsequent to a current date information Date 1 being stored in the NVRAM 104*d* as a process control executing date Date 2 (S6), the series of post-rise routine processings is finished.

In S2 of the post-rise routine processing, the current date information is acquired as Date 1. Following this, and subsequent to a process control executing date information Date 2 stored in the NVRAM 104*d* when the previous process control processing is executed being read (S3), a judgment as to whether Date 1 is equivalent to Date 2 (S4) is made. Thereupon, if the two are equivalent (Y in S4) and, accordingly, the power source OFF time or the energy save mode execution time is a medium period of time, the series of post-rise routine processings is finished without a process control processing being executed. In contrast, if the two are not equivalent (N in S4) and, accordingly, the power source OFF time or energy save mode execution time exceeds a medium period of time, the process control processing (S5) and the steps S6 and S7 as described above are executed.

Moreover, not only is the process control executing data stored in the NVRAM 104*d* as Date 2, a processing control execution time Time 2 may also be stored therein in accordance with a time signal output from a timing circuit 106*c*. In this case, the process control processing should be executed when the difference between the current time Time 1 and the process control execution time Time 2 exceeds a predetermined time.

Figure 6:
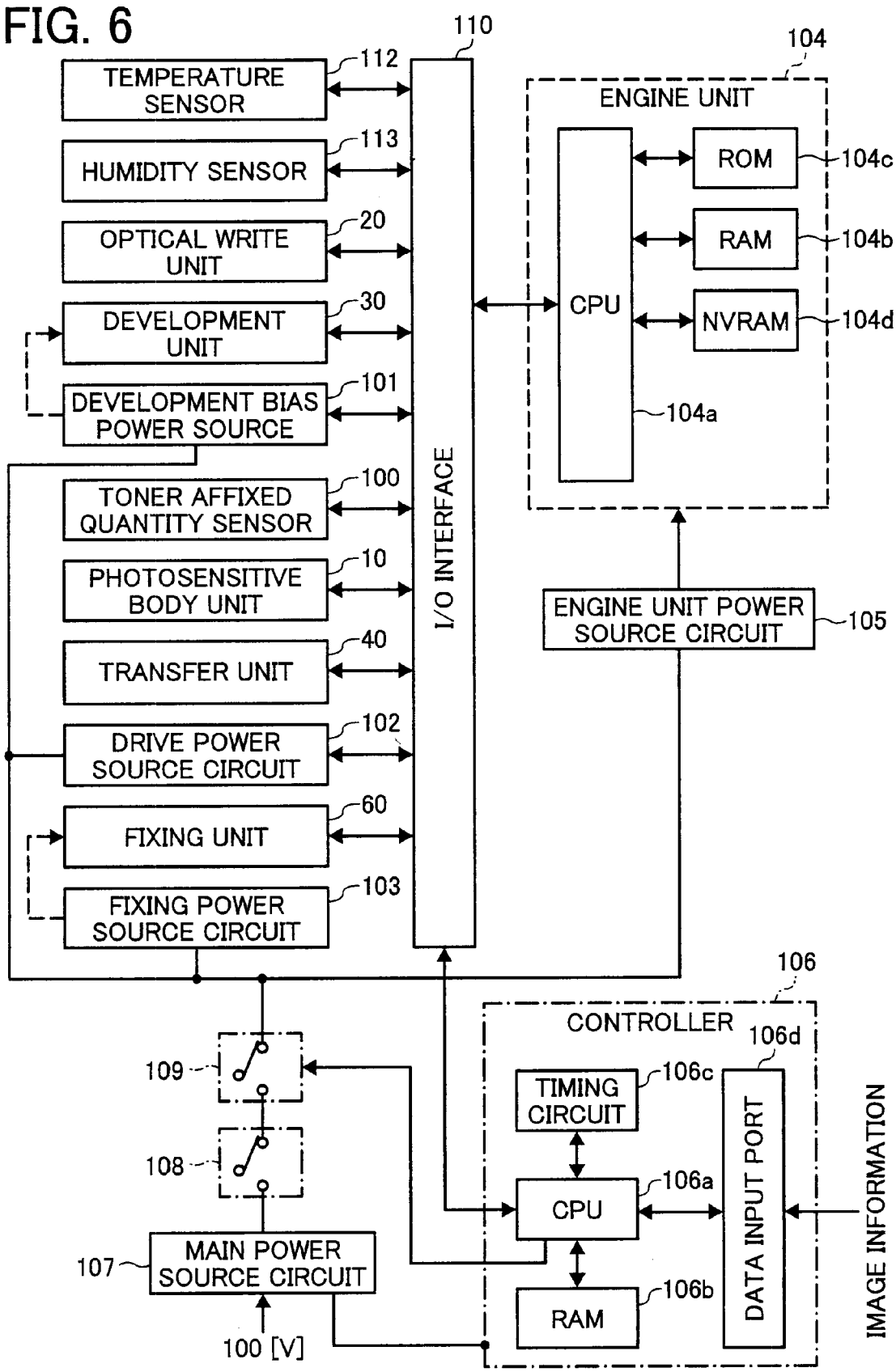
FIG. 6 is a block diagram of the main part of the electrical circuit of an apparatus pertaining to a modified example of the printer.

FIG. 6 shows the main part of the electrical circuit of an apparatus pertaining to a modified example of this printer. In this modified example of the apparatus a temperature sensor 112 and humidity sensor 113 are connected to the engine unit 104 by way of an I/O interface. Each of the temperature sensor 112 and humidity sensor 113 are arranged in proximity of a resistance roller pair (82 of FIG. 1). The temperature sensor 112 detects the temperature in the region of the resist roller pair using a common technique and outputs a temperature signal to the engine unit 104 in response to the detected result thereof. In addition, the humidity sensor 113 detects the humidity in proximity of the resist roller pair using a common technique and outputs a humidity signal to the engine unit 104 in response to the detected result thereof.

Figure 7A:
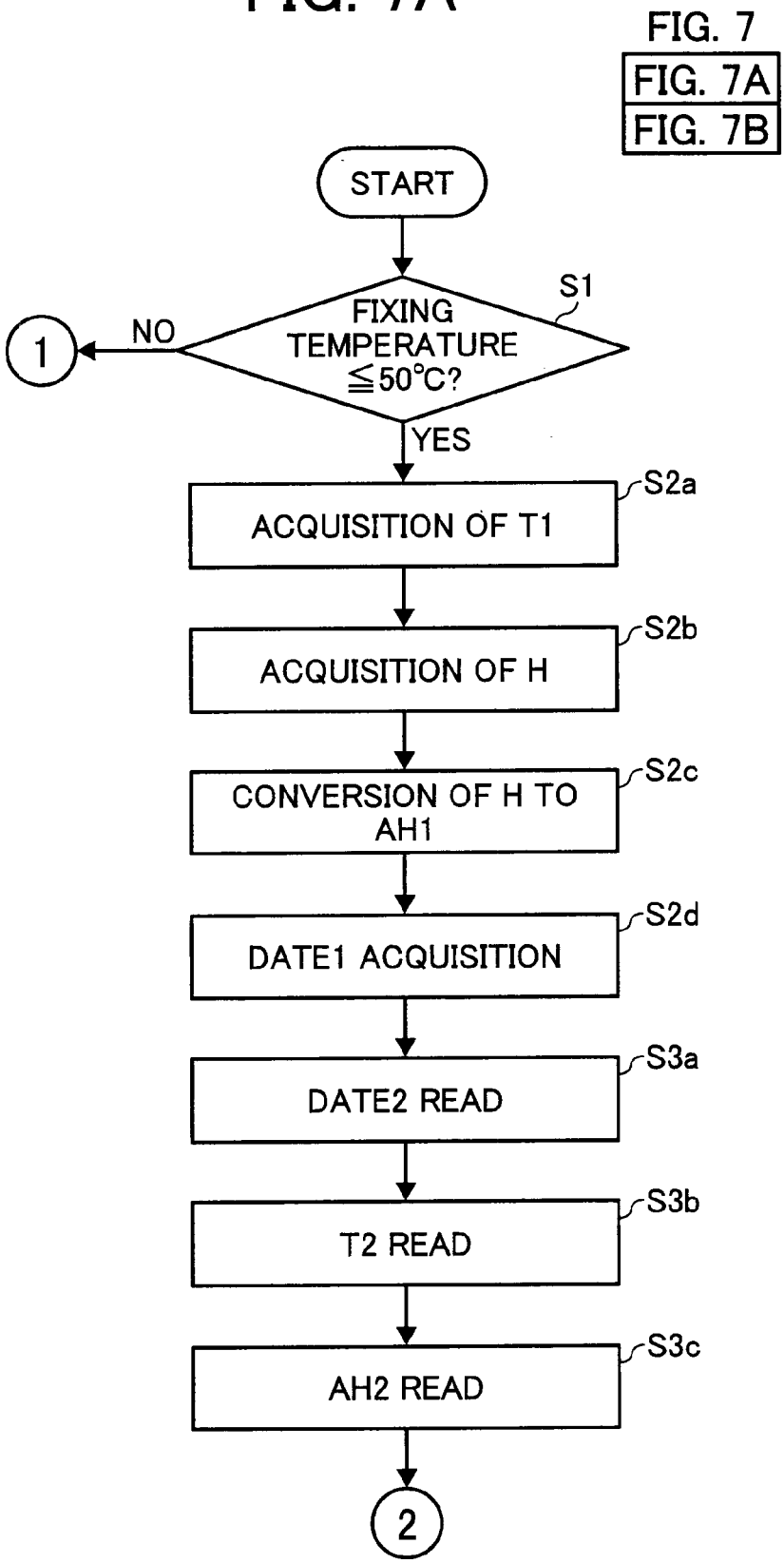
FIG. 7 is a flow chart showing the control flow of the post-rise routine processing executed by the apparatus of this modified example.
Figure 7B:
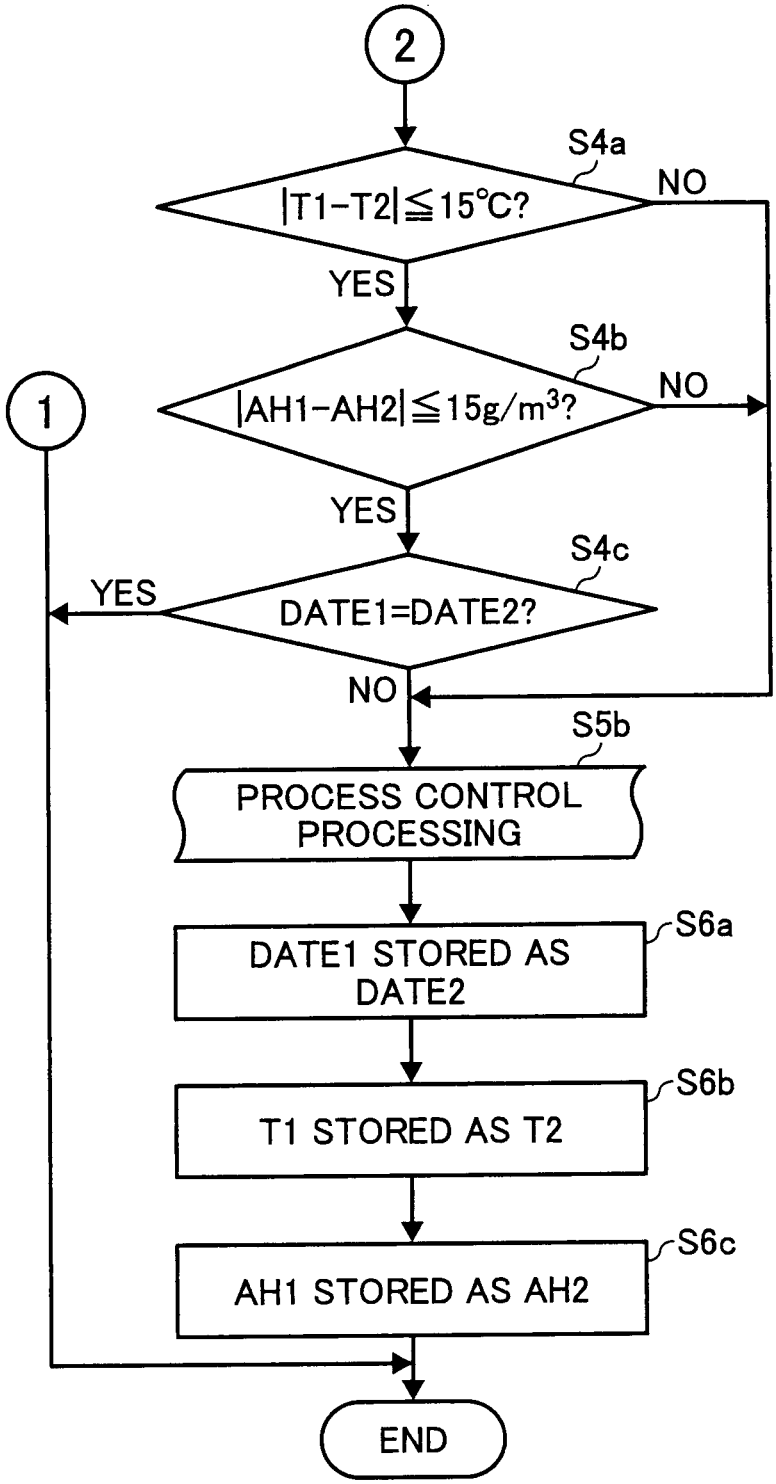

FIG. 7 is a flow chart showing the control flow of the post-rise routine processing of this modified example of the apparatus. The conditions taken considered in the executing of the process control processing (S5) in this control flow include, in addition to the date, the temperature and humidity. More specifically, following the acquisition of a current temperature information T1 in accordance with an output signal from the temperature sensor 112 (S2*a*), a current humidity information H is acquired in accordance with an output signal from the humidity sensor 113 (S2*b*). Thereupon, subsequent to the conversion of the current humidity information H to a current absolute humidity information AH1 using a predetermined algorithm (S2*c*), current date information Date 1 is acquired in accordance with a timing signal from the timing circuit 106*c* (S2*d*). Following this, the process control executing date information Date 2 stored in the NVRAM 104*d* when the previous process control processing is executed is read (S3*a*). In this modified example of the apparatus, the temperature information and absolute humidity information when the previous process control processing was executed are stored in the NVRAM 104*d* as process control execution time temperature information T2 and process control execution time absolute humidity information AH2. Subsequent to the reading of the process control execution data information Date 2, the process control execution time temperature information T2 and process control execution time absolute humidity information AH2 are read in sequence (S3*b*, 53*c*). Thereupon, a judgment as to whether the difference between the current temperature information T1 and the process control execution time temperature information T2 is not more than 15[° C.] is made (S4*a*) and, if it is not more than 15[° C.] (N in S4*a*), the process control processing is executed (S5).

On the other hand, if it is not more than 15[° C.] (Y in S4*a*), a judgment as to whether or not the difference between the current absolute humidity information AH1 and the control process execution time absolute humidity information AH2 is not more than 15 [g/m$^3$] (S4*b*) is made. Thereupon, if it exceeds 15 [g/m$^3$] (N in S4*b*), the process control processing is executed (S5). In contrast, if it is not more than 15 [g/m$^3$] (Y in S4*b*), a judgment as to whether or not Date 1 is equivalent to Date 2 is made (S4*c*) and, if the two are equivalent (Y in S4*c*), the series of post-rise routine processings is finished. In addition, if the two are not equivalent (N in S4*c*), the process control processing is executed.

In this modified example of the apparatus of this configuration, even if little time has elapsed from the previous process control processing, when a marked change in the temperature or humidity occurs the process control processing is executed to suppress the fluctuations in image quality attributable to such sudden temperature and humidity changes.

A second embodiment of a printer in which the present invention has application will be hereinafter explained. Unless otherwise specifically stated below, the configuration of the printer pertaining to this second embodiment is identical to the printer pertaining to the first embodiment described above.

The executing of the process control processing in this printer involves a switch between a normal process control processing and a simple process control processing in accordance with need. The normal process control processing is identical to the process control processing of the first embodiment. The simple process control processing involves measurement of imaging performance of visible image forming means in a shorter time than for normal process control processing. For example, while in the normal process control processing as described above a gradient pattern image of 17 gradients configured from 17 reference toner images is formed for each color, in the simple process control processing mode a gradient pattern image of a lesser number of gradients than this, for example, of 5 gradients, is formed. Also, one reference toner image may be formed for each color. In this case, provided the algorithm described in Japanese Unexamined Patent Application 2003-5465 is employed, the imaging performance can be determined in accordance with the toner affixed quantity of a single reference toner image. However, while the measurement speed of imaging performance is increased in all cases in which a single reference toner image of a gradient pattern image of less than 17 gradients is used, a drop in the measurement precision occurs.

Figure 8:
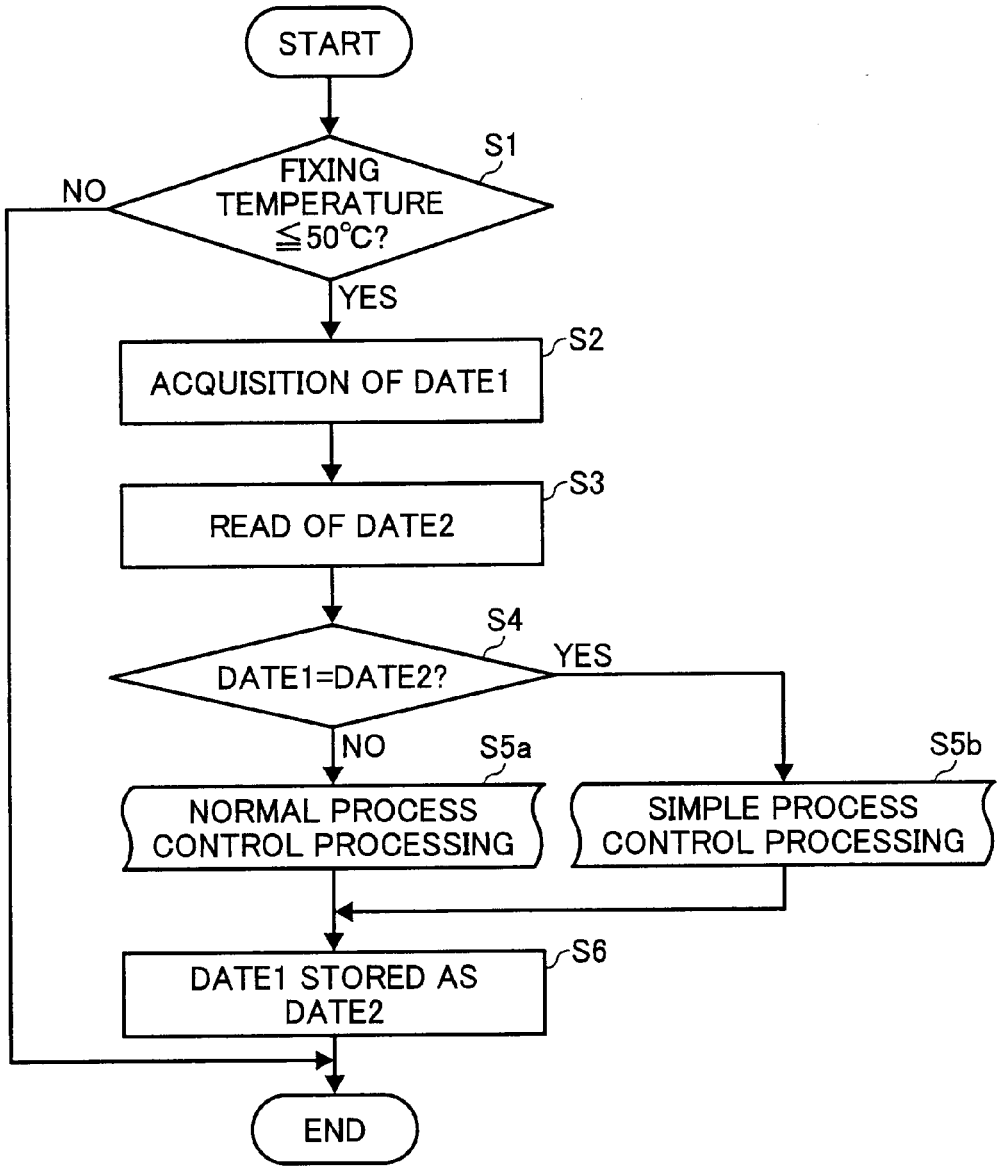
FIG. 8 is a flow chart showing the control flow of the post-rise routine processing of a printer pertaining to a second embodiment of the present invention.

FIG. 8 is a flow chart showing the control flow of the post-rise routine processings in this printer. The case in which Date 1 and Date 2 are equivalent differs from the control flow of FIG. 5 in that not only is the process control flow finished without the process control processing having been executed but also that, instead of the normal process control processing (S5*a*), the simple process control processing (S5*b*) is executed.

Figure 9A:
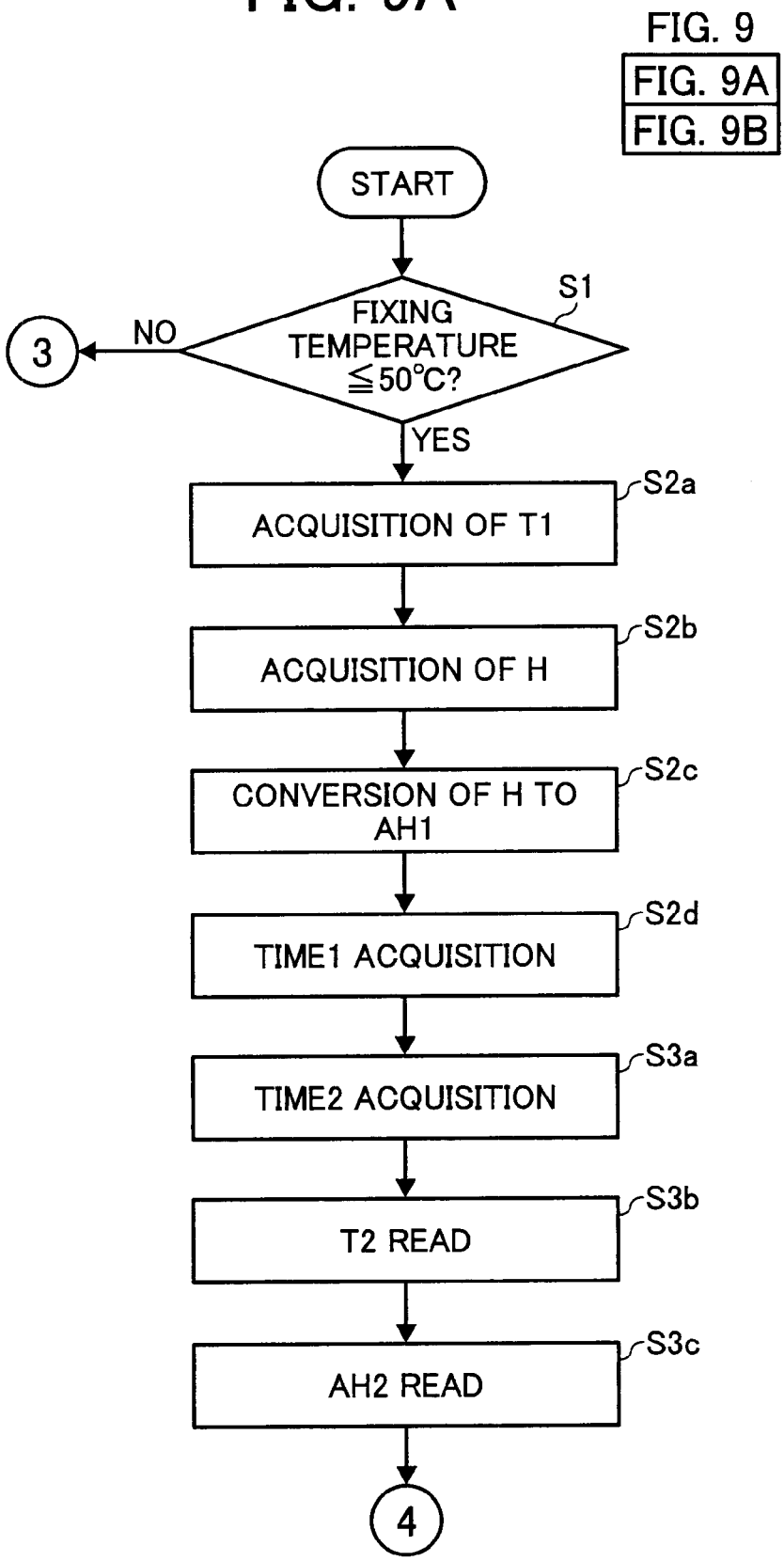
FIG. 9 is a flow chart showing the control flow of the post-rise routine processing executed by the apparatus pertaining to a modified example of this printer.
Figure 9B:
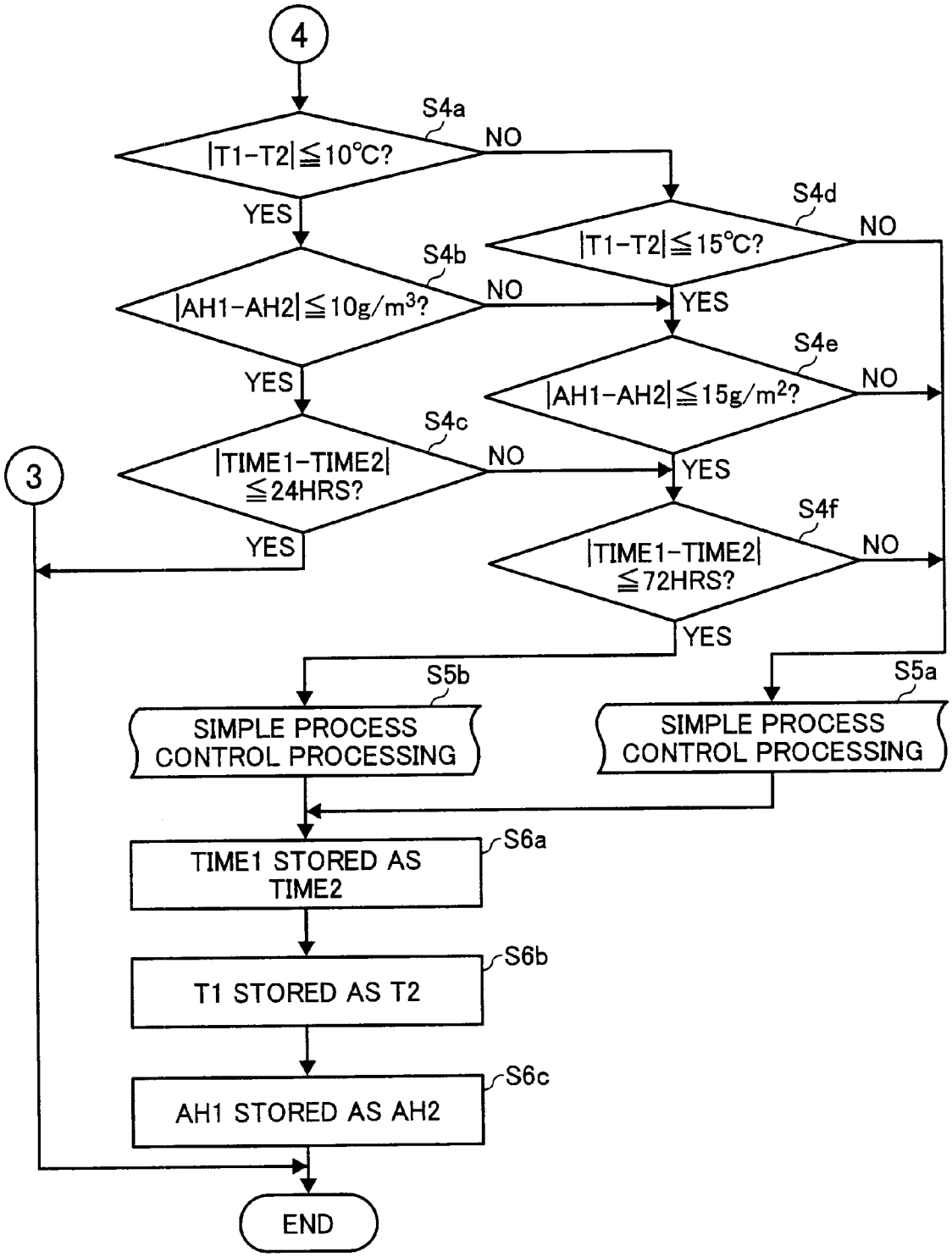

FIG. 9 is a flow chart showing the control flow of the post-rise routine processings in the apparatus pertaining to a modified example of this printer. In this modified example of the apparatus, replacing the current date information Date 1 or process control execution time date information Date 2 the current time information Time 1 or process control execution time information Time 2 are acquired and stored.

It shall be assumed in this modified example of the apparatus that the difference between the current temperature information T1 and the process control execution time temperature information T2 (hereinafter referred to as the temperature difference ΔT) is not more than 10[° C.], the difference between the current absolute humidity information AH1 and the control process execution time absolute humidity information AH2 (hereinafter referred to as the humidity difference ΔAH) is not more than 10 [g/m$^3$] and, in addition, the difference between the current time information Time 1 and process control execution time time information Time 2 (hereinafter referred to as the time difference ΔTime) is taken as not exceeding 24 hours. In this case, the flow advances in the sequence S4*a*→S4*b*→S4*c*→End, and the post-rise routine processings finish without the process control processing having been executed.

The normal process control processing is executed when, for example, the temperature difference ΔT exceeds 10[° C.] (S4*a*→S4*d*→S5*a*), the humidity difference ΔAH exceeds 15 [g/m$^3$] (S4*a*→S4*d*→S4*e*→S5*a* or S4*a*→S4*b*→S4*e*→S5*a*), or when the time difference ΔT exceeds 72 hours (S4*a*→S4*b*→S4*c*→S4*f*→S5*a*, S4*a*→S4*b*→S4*e*→S4*f*→S5*a* or S4*a*→S4*d*→S4*e*→S4*f*→S5*a*).

The simple process control processing is executed when the temperature difference ΔT exceeds 10[° C.] but does not exceed 15[° C.], when the humidity difference ΔAH exceeds 10 [g/m$^3$] but does not exceed 15 [g/m$^3$], and when the time difference ΔT is between 24 hours but does not exceed 72 hours (S4*a*→S4*d*→S4*e*→S4*f*→S5*a*). In addition, simple process control processing is also executed when the temperature difference ΔT does not exceed 10[° C.], the humidity difference ΔAH exceeds 10 [g/m$^3$] but does not exceed 15 [g/m$^3$], and the time difference ΔT exceeds 24 hours but does not exceed 72 hours (S4*a*→S4*b*→S4*e*→S4*f*→S5*a*). The simple process control processing is further executed when the temperature ΔT does not exceed 10[° C.}, the humidity difference ΔAH does not exceed 10 [g/m], and the time difference ΔT is between 24 hours but does not exceed 72 hours (S4*a*→S4*d*→S4*c*→S4*f*→S5*a*).

While the explanation given to this point has pertained to a printer for forming images using an electrophotographic system, the present invention is able to have application in image forming apparatuses in which ink jet systems are adopted. While execution of an energy save mode in ink jet systems is uncommon, the implementation of the ON/OFF of the power source thereof is similar to that which is employed in an electrophotographic system. It is likely that in the not too distant future an energy save mode based on disconnection of the power source supply to a control unit or an inkjet drive circuit will become available. The imaging conditions in these ink-jet systems include the voltage value imparted to a piezoelectric element of the power source or the implementation or non-implementation of ink-jet head cleaning. The imaging performance of an ink jet system can be ascertained by measurement by any kind of suitable method of the condition of the ink output from ink discharge holes of an ink jet head, or can be ascertained in accordance with the elapsed time from when the head cleaning was last implemented.

In executing a process control processing which constitutes an imaging condition setting control in the printer pertaining to the first embodiment and second embodiment described above, when the control unit serving as control means configured from an assembly of the engine unit 104 and the controller 106 stores imaging condition information (development bias VB, belt uniform charging potential VL, and optical write intensity VD) in the NVRAM 104*d* serving as non-volatile information storage means in response to the measured result of imaging performance of visible image forming means and, when power supply from the engine unit power source circuit 105 serving as the power source starts to be received, judges that the process control processing will not be executed in accordance with the Date 2 or Time 2 which constitutes storage information of the NVRAM 104*d* and, in addition, Date 1 or Time 1 based on a timing signal which constitutes output information from a timing circuit which constitutes information output means, the imaging conditions of visible image forming means are set to conditions identical to the storage information of the NVRAM 104*d*. According to this configuration, even if a process control processing is not executed immediately following the power source being switched ON or immediately following rise from the energy save mode, images of stable image quality image can be output by forming of images at the imaging conditions that have been set by the previous process control processing.

In addition, the printer pertaining to the first embodiment and second embodiment described above comprises a CPU 104*a* serving as timing means for timing the elapsed time from either when the acquisition of image information by a data input port 106*d* serving as image acquisition means has finished or when an image forming operation is finished, a CPU 104*a* serving as judgment means for judging whether or not the power supply from an energy unit power source circuit 105 to an engine unit 104 is to be cutoff in accordance with the timing result produced by timing means, and a relay circuit 109 serving as output disconnection means for, in accordance with a control signal from a controller 106 which constitutes a part of control means, disconnecting the supply of power from the energy unit power source circuit 105 to the engine unit 104 and, in addition, a controller 106 which constitutes one part of control means for controlling the relay circuit 109 in accordance with the image information input to the data input port 106*d* and the judgment result of the CPU 104*a*. According to this configuration, the energy save mode can be executed by cutoff of the power supply from the energy unit power source circuit 105 to the engine unit 104 when the timing result produced by the CPU 104*a* exceeds a predetermined time.

In addition, in the printer pertaining to the first embodiment and second embodiment described above, because a timing circuit 106*c* for outputting at least date information is employed to serve as information output means, the difference between the date when the previous process control processing is executed and the date directly following the power source being switched ON or directly following reversion from the energy save mode exceeding a predetermined value can be adopted as the process control processing execution trigger.

In addition, in the printer pertaining to the first embodiment and second embodiment described above, because a temperature sensor serving as temperature detection means for detecting temperature and outputting information of the detected result thereof is employed as information output means, the difference between the temperature when the previous process control processing is executed and the temperature directly following the power source being switched ON or directly following reversion from the energy save mode exceeding a predetermined value can be adopted as the process control processing execution trigger.

In addition, in the printer pertaining to the first embodiment and second embodiment described above, because a humidity sensor serving as humidity detection means for detecting humidity and outputting information of the detected result thereof is employed as information output means, the difference between the humidity when the previous process control processing is executed and the humidity directly following the power source being switched ON or directly following reversion from the energy save mode exceeding a predetermined value can be adopted as the process control processing execution trigger.

In addition, in the printer pertaining to the first embodiment and second embodiment described above, because means for forming a toner image that constitutes a visible image based on an electrophotographic system is employed as visible image forming means, images can be formed at a higher speed than is possible when an ink-jet system is employed.

In addition, in the printer pertaining to the first embodiment and second embodiment described above, because a control unit which constitutes control means sets an imaging potential condition as one imaging condition of visible image forming means, the imaging performance of visible image forming means can be regulated by regulating the imaging potential.

The merits of the present invention described above are outlined below:

(1) A stabilization of image quality can be achieved by executing of an imaging condition setting control.

(2) Information output means changes its output signal in response to changes in events such as time, temperature and humidity. Thereupon, subsequent to imaging condition setting control having been executed, control means stores information such as the timing signal and so on output from information output means at that time in non-volatile information storage means. Even when supply of power to control means is prevented as a result of the power source being cutoff or the energy save mode being executed, this stored information is retained without alteration in non-volatile information storage means. When the supply of power starts to be again received following the cutoff of supply of power due to the ON/OFF of the power source or shift or reversion to the energy save mode, control means compares the time signal, temperature signal and humidity signal and so on output from information output means at this time with the time information, humidity information and temperature information stored in non-volatile information storage means when the previous imaging condition setting control was executed. As a result of this comparison, the magnitude of the environmental fluctuations occurring between the present time and when the previous imaging condition setting control was executed is ascertained. By executing of the imaging condition setting control only when the magnitude of the environment fluctuations are marked, the unnecessary executing of imaging condition setting control is avoided. As a result, the occurrence of the user being made to wait unnecessarily, the shortening of the lifespan of visible image forming means and the needless consumption of image forming agents caused by unnecessary execution of the imaging condition setting control can be better suppressed than in the conventional art.

(3) When it is judged in accordance with a comparison of the signals output from imaging output means when the power supply starts to be received again and the signal information stored in non-volatile imaging storage means when the previous imaging condition setting control is executed that the changes in the environment from when the previous imaging condition setting control was executed are not that marked, a short time mode imaging condition setting control is executed. As a result, when there is little need for execution of imaging condition setting control, the occurrence of the user being made to wait unnecessarily, the shortening of the lifespan of visible image forming means and the needless consumption of image forming agents caused by unnecessary execution of the imaging condition setting control can be better suppressed than in the conventional art by prompt measurement of the imaging potential of visible image forming means.

Various modifications will become possible for those skilled in the art after receiving the teachings of the present disclosure without departing from the scope thereof.

What is claimed is:

1. An image forming apparatus comprising:

image information acquisition means for acquiring image information;

visible image forming means for forming a visible image on a surface of an image carrier in accordance with the image information;

control means for measuring imaging performance of the visible image forming means in response to a start of a power supply from a power source and for controlling execution of an imaging condition setting control for setting imaging conditions based on, at least, the measured result; and information output means for determining and outputting signal information corresponding to factors affecting formation of the visible image on the surface of the image carrier by the visible image forming means, wherein the control means includes non-volatile information storage means for storing information and retaining stored information even when the supply of power from the power source has been interrupted, stores, in the non-volatile information storage means, signal information output from the information output means when executing the imaging condition setting control, and controls execution of the imaging condition setting control further based on both previous signal information stored in the non-volatile information storage means and a current signal information output from the information output means, and wherein the control means further includes timing means for timing an elapsed time since either an acquisition of image information by the image information acquisition means finishes or an image forming operation is finished;

judgment means for judging whether or not power supply to the control means from the power source is to be cutoff in accordance with the timed result of the timing means, and power disconnection means for disconnecting the power supply to the control means from the power source in accordance with the control signal from the control means, and wherein the control means is further configured to control an input of the image information to the image information acquisition means and the power disconnection means in accordance with the judgment result of the judgment means.

2. The image forming apparatus as claimed in claim 1, wherein a timing circuit which outputs at least a date as the signal information is employed as the information output means.

3. The image forming apparatus as claimed in claim 1, wherein temperature detection means which detects temperature and outputs a temperature as the signal information is employed as the information output means.

4. The image forming apparatus as claimed in claim 1, wherein humidity detection means which detects humidity as the signal information is employed as the information output means.

5. The image forming apparatus as claimed in claim 1, wherein means of forming a visible image using an electrophotographic system is employed as the visible image forming means.

6. The image forming apparatus as claimed in claim 5, wherein the control means sets an imaging potential condition as the imaging condition.

7. An image forming apparatus comprising:

image information acquisition means for acquiring image information;

visible image forming means for forming a visible image on a surface of an image carrier in accordance with the image information;

control means for measuring imaging performance of the visible image forming means in response to a start of a power supply from a power source and for controlling execution of an imaging condition setting control for setting imaging conditions based on, at least, the measured result; and information output means for determining and outputting signal information corresponding to factors affecting formation of the visible image on the surface of the image carrier by the visible image forming means, wherein the control means includes non-volatile information storage means for storing information and retaining stored information even when the supply of power from the power source has been interrupted, stores, in the non-volatile information storage means, signal information output from the information output means when executing the imaging condition setting control, and controls execution of the imaging condition setting control further based on a determination of whether a long time mode in which the imaging performance of the visible image forming means is measured over a comparatively long time or a short time mode in which the imaging performance is measured over a comparatively short time is to be executed and based on both a previous signal information stored in the non-volatile information storage means and a current signal information output from the information output means.

8. The image forming apparatus as claimed in claim 7, wherein the control means further includes timing means for timing an elapsed time since either an acquisition of image information by the image information acquisition means finishes or an image forming operation is finished;

judgment means for judging whether or not power supply to the control means from the power source is to be cutoff in accordance with the timed result of the timing means; and power disconnection means for disconnecting the power supply to the control means from the power source in accordance with the control signal from the control means, wherein the control means is further configured to control an input of the image information to the image information acquisition means and the power disconnection means in accordance with the judgment result of the judgment means.

9. The image forming apparatus as claimed in claim 7, wherein a timing circuit which outputs at least a date as the signal information is employed as the information output means.

10. The image forming apparatus as claimed in claim 7, wherein temperature detection means which detects temperature and outputs temperature as the signal information is employed as the information output means.

11. The image forming apparatus as claimed in claim 7, wherein humidity detection means which detects humidity as the signal information is employed as the information output means.

12. The image forming apparatus as claimed in claim 7, wherein means of forming a visible image using an electrophotographic system is employed as the visible image forming means.

13. The image forming apparatus as claimed in claim 12, wherein the control means sets an imaging potential condition as the imaging condition.

* * * * *